US007017957B2

(12) United States Patent
Murphy et al.

(10) Patent No.: US 7,017,957 B2
(45) **Date of Patent: *Mar. 28, 2006**

(54) SASH LOCK FOR A SASH WINDOW

(75) Inventors: Mark V. Murphy, Oak Park, IL (US); Dean Pettit, St. John, IN (US)

(73) Assignee: Ashland Products, Inc., Lowell, IN (US)

( * ) Notice: Subject to any disclaimer, the term of this patent is extended or adjusted under 35 U.S.C. 154(b) by 48 days.

This patent is subject to a terminal disclaimer.

(21) Appl. No.: 10/337,181

(22) Filed: Jan. 6, 2003

(65) Prior Publication Data

US 2003/0151262 A1 Aug. 14, 2003

Related U.S. Application Data

(63) Continuation-in-part of application No. 09/961,501, filed on Sep. 24, 2001, now Pat. No. 6,568,723.

(51) Int. Cl.
*E05C 3/04* (2006.01)

(52) U.S. Cl. ..... 292/241; 292/DIG. 47

(58) Field of Classification Search ..... 292/240, 292/241, DIG. 7, DIG. 47, DIG. 38
See application file for complete search history.

(56) References Cited

U.S. PATENT DOCUMENTS

| | | | | |
|---|---|---|---|---|
| 201,146 | A | 3/1878 | Adler | |
| 336,302 | A | 2/1886 | Dudgeon | |
| 480,148 | A | 8/1892 | Theby | |
| 878,206 | A | 2/1908 | Johnson | |
| 1,041,803 | A | 10/1912 | Kilburn | |
| 1,059,999 | A | 4/1913 | James et al. | |
| 1,198,166 | A * | 9/1916 | Stoddard | 220/327 |
| 1,253,810 | A | 1/1918 | Gianninoto | |
| 1,393,628 | A | 10/1921 | Leichter | |
| 1,550,532 | A | 8/1925 | French | |
| 1,704,946 | A | 3/1929 | Lindgren | |
| 1,901,974 | A | 3/1933 | Macy | |
| 2,537,736 | A | 1/1951 | Carlson | |
| 3,027,188 | A | 3/1962 | Eichstadt | |

(Continued)

FOREIGN PATENT DOCUMENTS

| | | |
|---|---|---|
| GB | 341207 | 1/1931 |
| GB | 2026594 | 2/1980 |

OTHER PUBLICATIONS

Page 21, Home Protection Hardware Catalog Price List, dated Jul. 1986.

*Primary Examiner*—Gary Estremsky
(74) *Attorney, Agent, or Firm*—Wallenstein Wagner & Rockey, Ltd.

(57) ABSTRACT

A sash lock (10) is provided for a sash window assembly (12). The sash window assembly includes an upper sash window (14) and a lower sash window (16). Each of the sash windows (14, 16) are mounted within opposed guide rails (20) on a master frame (22) wherein at least one of the sash windows is slidable within the frame (20) relative to the other sash window. The sash window assembly (12) further includes a keeper (26) for mounting on a rail of one of the sash windows. The keeper (26) includes a keeper surface (26*a*). The sash lock (10) includes a locking assembly (28) for mounting on an adjacent rail of the other of the sash windows. The locking assembly (28) includes a housing (30) having an aperture (32), an actuator arm (34) having a shaft (38) disposed along a rotational axis and within the aperture (32) of the housing (30), and a cam (36) having a cam surface (36*a*) for engaging the keeper surface (26*a*) of the keeper (26). The cam (36) also includes an engagement member (40, 52) to engage the shaft (38) of the actuator arm (34). The housing (30) of the locking assembly (28) includes two alignment tabs (33) that are each adapted to engage one of two alignment surfaces (26*d*) of the keeper (26).

27 Claims, 5 Drawing Sheets

U.S. PATENT DOCUMENTS 3,438,153 A 4/1969 Lemme
3,645,573 A 2/1972 Strang
3,655,230 A 4/1972 Armstrong
3,811,718 A 5/1974 Bates
4,227,345 A 10/1980 Durham, Jr.
4,305,612 A 12/1981 Hunt et al.
4,558,174 A 12/1985 Massey
4,736,972 A * 4/1988 Mosch ..... 292/204
4,801,164 A 1/1989 Mosch
4,961,286 A 10/1990 Bezubic
5,042,855 A 8/1991 Bennett et al.
5,072,464 A 12/1991 Draheim et al.
5,076,015 A 12/1991 Manzalini
5,087,088 A 2/1992 Milam
5,090,750 A 2/1992 Lindqvist
5,127,685 A 7/1992 Dallaire et al.
5,139,291 A 8/1992 Schultz
5,161,839 A 11/1992 Piltingsrud et al.
5,398,447 A 3/1995 Morse
5,582,445 A 12/1996 Olsen et al.
RE35,463 E 2/1997 Vetter et al.
5,741,032 A * 4/1998 Chaput ..... 292/202
5,992,907 A 11/1999 Sheldon et al.
6,116,665 A 9/2000 Subliskey
6,142,541 A 11/2000 Rotondi

* cited by examiner

SASH LOCK FOR A SASH WINDOW

CROSS-REFERENCE TO RELATED APPLICATIONS

This Application is a continuation-in-part of application Ser. No. 09/961,501, filed Sep. 24, 2001 now U.S. Pat. No. 6,568,723.

TECHNICAL FIELD

The present invention relates to a sash lock for a sash window.

BACKGROUND OF THE INVENTION

Sash locks for double hung window assemblies are commonly known in the art. A double hung window assembly generally has an upper sash window and a lower sash window within a master frame. Typical sash locks draw opposed frame members of the sash windows together and lock the sashes preventing them from sliding within the master frame.

No known sash locks include a cam having one or more retaining protrusions that increase surface engagement between the cam and an actuator arm, thereby providing a more robust engagement between the two parts, minimizing alignment displacement between the two parts, as well as providing a more robust design for assembly.

The present invention provides these features, as well as other features that solve problems with known sash locks.

SUMMARY OF THE INVENTION

A sash lock is provided for a sash window assembly.

The sash window assembly includes an upper sash window and a lower sash window. Each of the sash windows are mounted within opposed guide rails on a master frame wherein at least one of the sash windows is slidable within the frame relative to the other sash window. The sash lock includes a keeper for mounting on a base rail of one of the sash windows. The keeper includes a keeper surface. The sash lock also includes a locking assembly for mounting on an adjacent top rail of the other of the sash windows. The locking assembly includes a housing having an aperture, an actuator arm having a shaft disposed along a rotational axis and within the aperture of the housing, and a cam having a cam surface for engaging the keeper surface of the keeper. The cam also includes at least one protrusion extending transversely in relation to the bearing surface to engage the shaft of the actuator arm.

According to another aspect of the invention, the keeper, the housing, and the actuator arm are formed of a plastic material and the cam is formed of a metal material.

According to another aspect of the invention, the shaft includes at least one slot peripherally disposed about a blind hole of the shaft that correspondingly engages with the at least one protrusion of the cam.

According to yet another aspect of the invention, the at least one peripherally-disposed slot defines at least one shaft portion peripherally disposed about the blind hole, wherein the at least one shaft portion deflects and squeezes the at least one protrusion of the cam in response to advancement of a screw disposed within a thru-hole of the cam and the blind hole of the shaft when torque is applied to the screw during assembly.

These and other aspects of the invention are exemplified by the drawings and description herein.

DETAILED DESCRIPTION OF THE PREFERRED EMBODIMENTS

Figure 1:
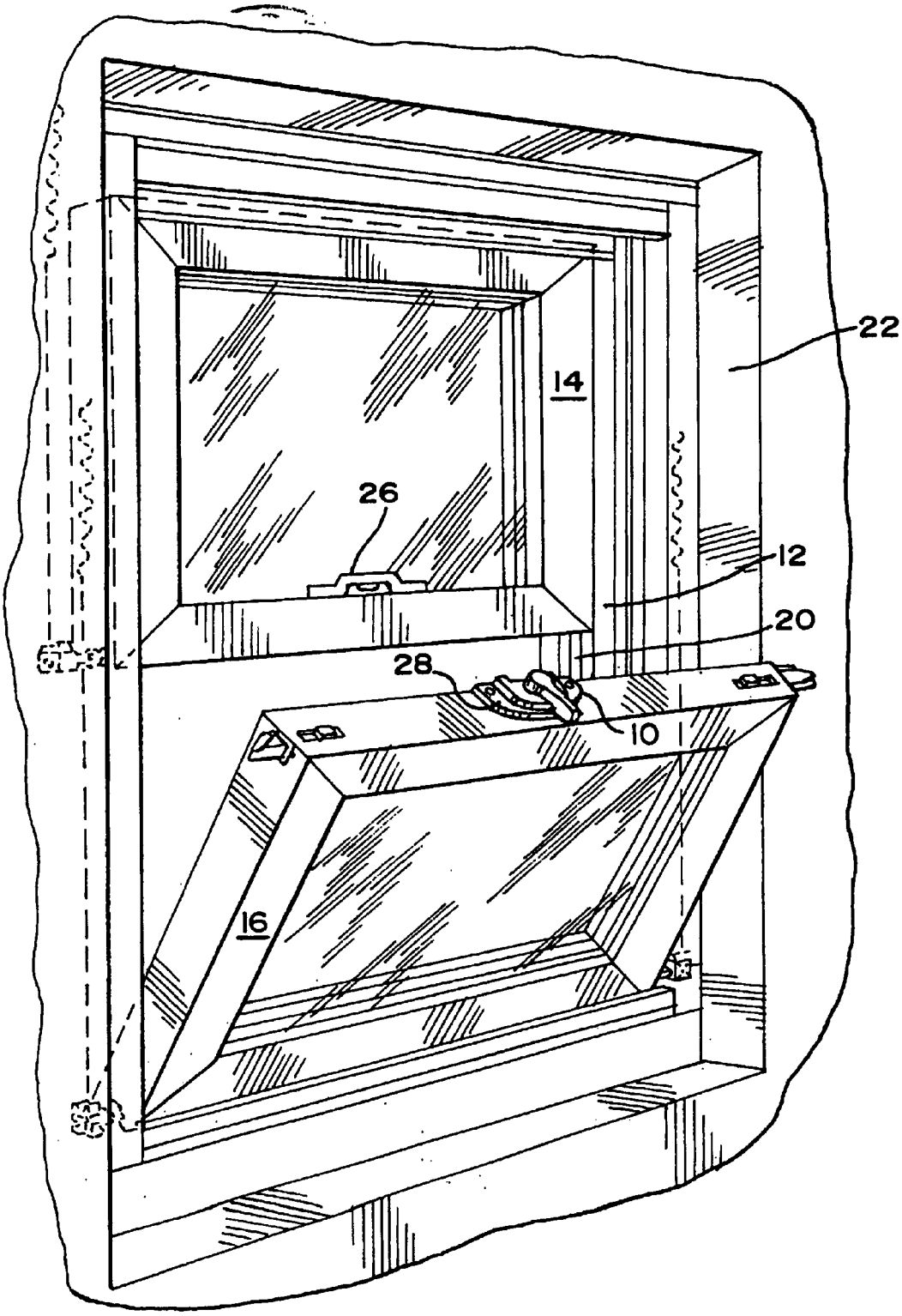
FIG. 1 is a perspective view of a sash window assembly having a sash lock in accordance with the present invention.

While this invention is susceptible of embodiment in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

A sash lock 10 for a sash window assembly 12 is illustrated in FIGS. 1–6. Referring to FIG. 1, the sash window assembly 12 includes an upper sash window 14 and a lower sash window 16. Each of the sash windows 14, 16 is mounted within opposed guide rails 20 on a master frame 22. At least one of the sash windows 14, 16 is slidable within the frame 22 relative to the other of the sash windows 14, 16.

As shown in FIGS. 1–6, the sash lock 10 generally includes a keeper 26 and a locking assembly 28. The keeper 26 is mounted on a bottom rail of the upper sash window 14.

Figure 3A:
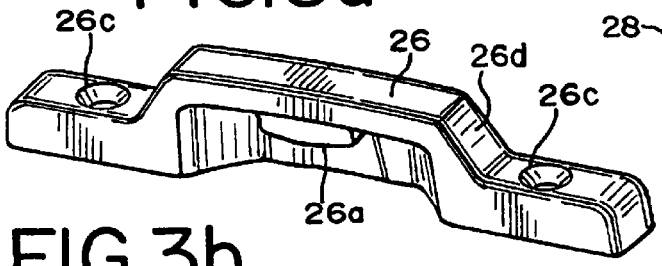
FIG. 3*a* is a perspective view of a keeper of the sash lock of FIGS. 2*a*–2*c*.
Figure 3B:
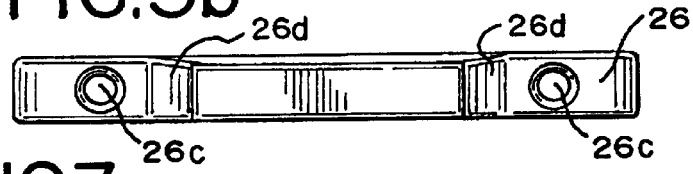
FIG. 3*b* is a top plan view of the keeper of FIG. 3*a*.
Figure 3C:
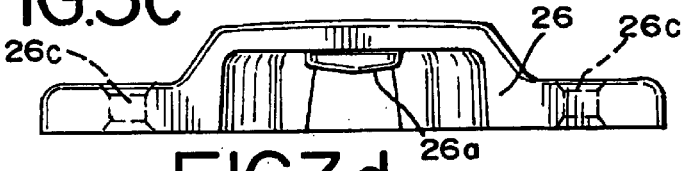
FIG. 3*c* is a front elevation view of the keeper of FIG. 3*a*.
Figure 3D:
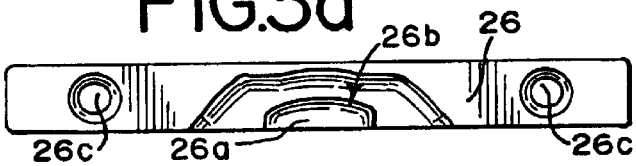
FIG. 3*d* is a bottom plan view of the keeper of FIG. 3*a*.
Figure 4A:
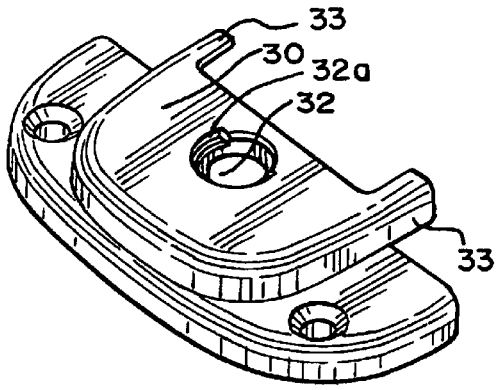
FIG. 4*a* is a perspective view of a housing of a locking assembly of the sash lock of FIGS. 2*a*–2*c*.
Figure 4B:
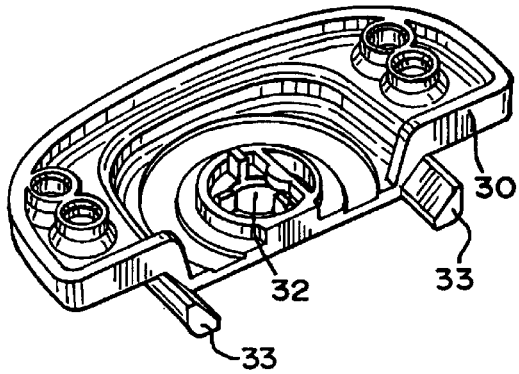
FIG. 4*b* is a perspective view of the housing of FIG. 4*a* showing an interior portion of the housing.

The keeper 26 includes a keeper protrusion 26*a* having a keeper surface 26*b*, as shown in FIG. 3*d*. The locking assembly 28 is mounted on an adjacent top rail of the lower sash window 16. The locking assembly 28 includes a housing 30 having a hole or aperture 32 and two alignment tabs 33 (FIG. 4*a*), an actuator arm 34 (FIG. 5*a*), and a cam 36 (FIG. 6*a*) having a cam surface 36*a* for engaging the keeper surface 26*a*. The locking assembly 28 also includes a shaft 38 extending through the housing aperture 32 and operably coupling the actuator arm 34 to the cam 36. In one preferred embodiment, the actuator arm 34 and the shaft 38 are integrally formed. As shown in FIG. 4*a*, the housing 30 has a pair of holes for receiving screws (not shown) to secure the housing 30 to the rail of the sash window 16. As shown in FIG. 3*a*, the keeper 26 has a pair of keeper holes 26*c* for receiving screws (not shown) to secure the keeper 26 to the rail of the sash window 14.

Figure 2A:
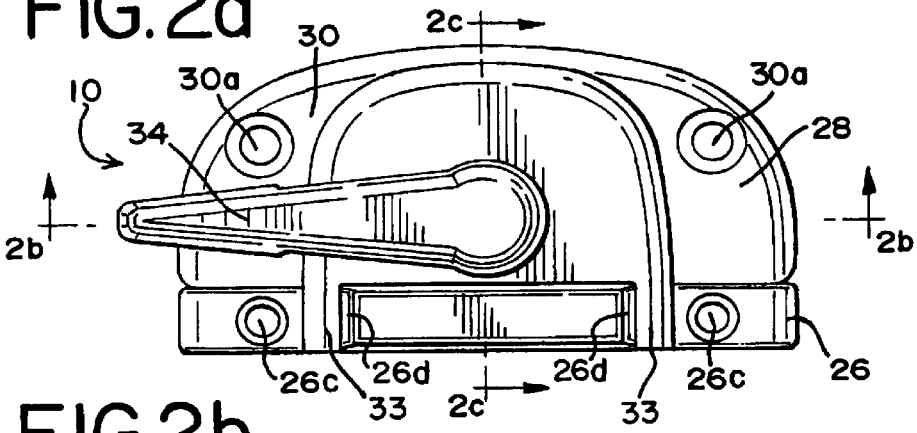
FIG. 2*a* is a top plan view of the sash lock of FIG. 1.

The keeper 26 and the locking assembly 28 are shown locked together in FIG. 2*a*. Two alignment tabs 33 on the housing 30 of the locking assembly 28 aid in alignment of the keeper 26 and the locking assembly 28 when they are initially engaged. The alignment tabs 33 also prevent any unwanted lateral movement between the keeper 26 and the locking assembly 28 to provide a more robust engagement. Each of the tabs 33 engage an alignment surface 26*d* disposed on the keeper 26, as shown in FIG. 2*a*.

The keeper 26, the housing 30, the actuator arm 34 and the shaft 38 are formed of a plastic material. The plastic material is preferably a glass-filled polypropylene, glass-filled nylon, or a blend of glass-filled polypropylene and nylon. In one preferred embodiment, the plastic is a blend of polypropylene, nylon and glass additives such as glass fiber and glass bead. Additives for impact and weathering performance may also be used. Other plastic materials can also be utilized. The cam 36 is formed of a metal, preferably zinc or a zinc alloy. Other metals may also be used.

Figure 2B:
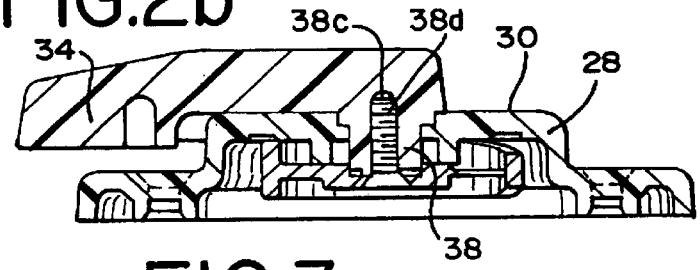
FIG. 2*b* is a cross-sectional view of the sash lock taken along line 2*b*—2*b* in FIG. 2*a*.
Figure 4C:
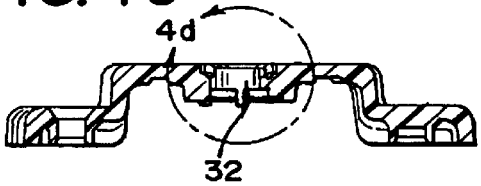
FIG. 4*c* is a cross-sectional view of the housing of FIGS. 4*a*–4*b*.
Figure 4D:
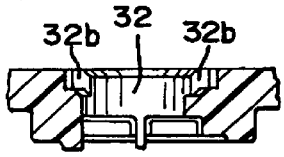
FIG. 4*d* is a detailed view of FIG. 4*c*.
Figure 5A:
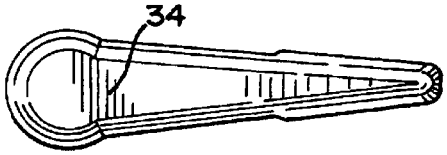
FIG. 5*a* is a top plan view of an actuator arm of the sash lock of FIGS. 2*a*–2*c*.
Figure 5B:
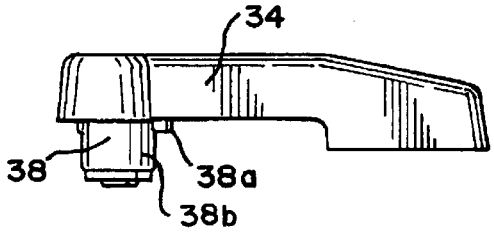
FIG. 5*b* is a front elevation view of the actuator arm of FIG. 5*a*.

As shown in FIG. 2*b*, the shaft 38 engages the cam 36 and rotatably secures the shaft 38 to the cam 36. Referring to FIG. 5*b*, the shaft 38 has a shaft projection 38*a* disposed on an outer shaft surface 38*b* of the shaft 38. The aperture 32 includes a peripheral channel 32*a* disposed about a portion of the periphery of the aperture 32 to define a pair of end surfaces 32*b*, as shown in FIGS. 4*a*, 4*c* and 4*d*. The shaft projection 38*a* engages one or the other of the end surfaces 32*b* to limit rotational travel of the actuator arm 34 and thereby define unlocked and locked positions, respectively.

Figure 2C:
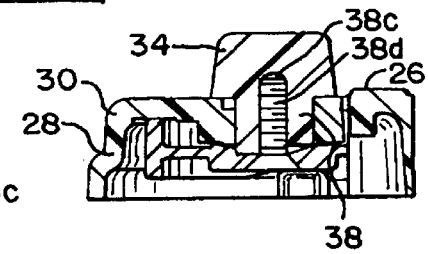
FIG. 2*c* is a cross-sectional view of the sash lock taken along line 2*c*—2*c* in FIG. 2*a*.

The shaft 38 has a screw-receiving aperture or blind hole 38*c* to receive a metal screw 38*d*, as shown in FIGS. 2*b*–2*c*, to secure the cam 36 to the shaft 38. When assembled, the screw 38*d* is disposed within a thru-hole 39 of the cam 36 and the blind hole 38*c* of the shaft 38. In a preferred embodiment, the blind hole 38*c* is of a design that accepts a thread-forming screw. Alternatively, the blind hole 38*c* has threads machined or pre-formed therein. The actuator arm 34 rotates about a rotational axis defined by the shaft 38.

Figure 5C:
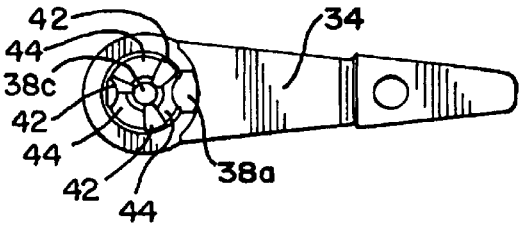
FIG. 5*c* is a bottom plan view of the actuator arm of FIG. 5*a*.
Figure 6A:
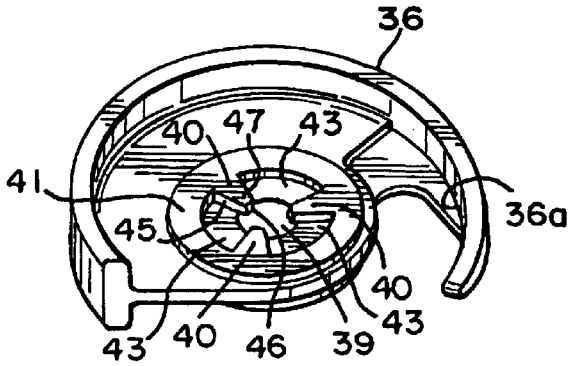
FIG. 6*a* is a perspective view of a cam of the sash lock of FIGS. 2*a*–2*c*.
Figure 6B:
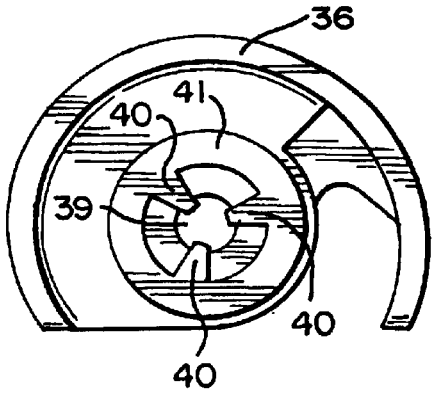
FIG. 6*b* is a top plan view of the cam of FIG. 6*a*.
Figure 6C:
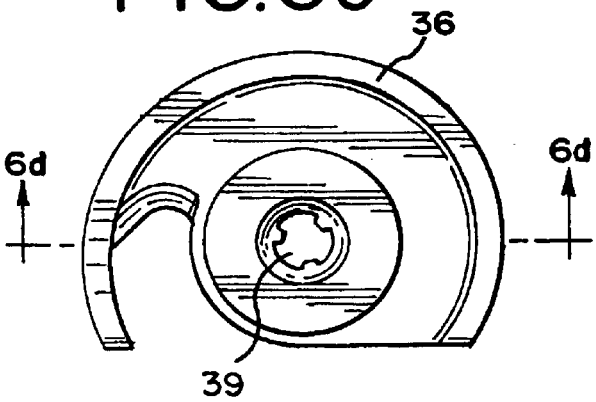
FIG. 6*c* is a bottom plan view of the cam of FIG. 6*a*.
Figure 6D:
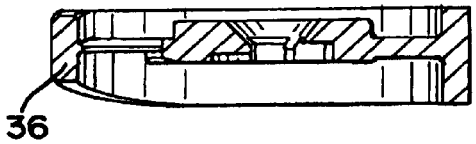
FIG. 6*d* is a cross-sectional view of the cam taken along line 6*d*—6*d* in FIG. 6*c*.

Referring to FIGS. 6*a* and 6*b*, the cam 36 includes engagement members in the form of three protrusions 40 peripherally arranged adjacent to a face surface 41. The three protrusions 40 are circumferentially-spaced around the thru-hole 39 wherein three cavities 43 are defined between the protrusions 40. The cavities 43 are wedge-shaped. The protrusions 40 provide an interlocking engagement with three slots 42 peripherally disposed about the blind hole 38*c* of the shaft 38. The slots 42 are shown in FIG. 5*c* and are shaped to correspondingly engage the protrusions 40. The slots 42 define three shaft engagement portions 44 each having a generally wedge-shaped cross-section when taken perpendicular to the rotational axis of the actuator arm 34. It should be noted that this engagement can also be implemented by utilizing one, or any other number, of protrusion/slot combinations. As shown in FIG. 6*a*, each the protrusions 40 define a pair of side surfaces 45, that face inwards to the cavities 43, and an end surface 46 at a distal end 47 of each of the protrusions 40. The side surfaces 45 provide surface engagement with the shaft engagement portions 44 that fit into and are received by the cavities 43. This surface engagement enhances the engagement of the shaft 38 of the actuator arm 34 to the cam 36 to resist undesirable movement therebetween. For example, this surface engagement prevents undesirable rotational movement between the shaft 38 of the actuator arm 34 and the cam 36 when a force is applied to the actuator arm 34 to rotate the cam 36.

The end surfaces 46 of the protrusions 40, and interior surfaces of the blind hole 38*c* defined by each of the shaft engagement portions 44, together provide surface engagement for the screw 38*d*. The screw engagement is shown in FIGS. 2*b* and 2*c*. In a preferred embodiment, the screw 38*d* is a thread forming screw having threads that cut into the surface defined by the end surfaces 46 and the shaft engagement portions 44.

Figure 7:
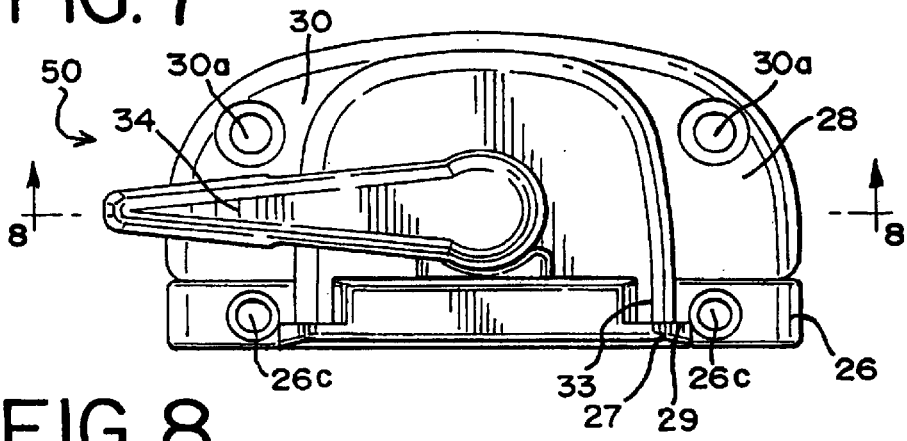
FIG. 7 is a perspective view of a second embodiment of a sash lock in accordance with the present invention.
Figure 8:
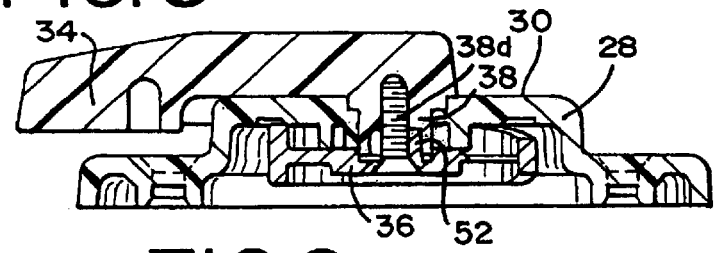
FIG. 8 is a cross-sectional view of the sash lock taken along line 8—8 in FIG. 7.
Figure 9:
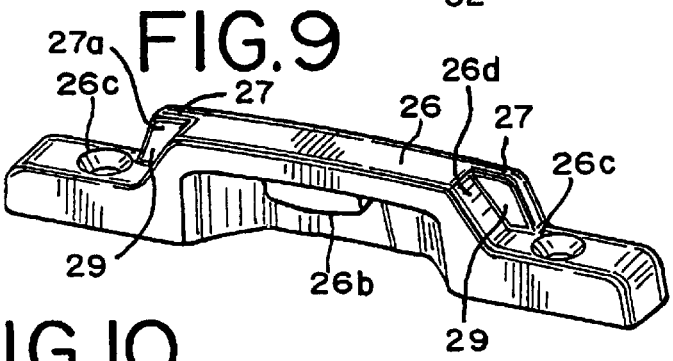
FIG. 9 is a perspective view of a keeper of the sash lock of FIGS. 7–8.
Figure 10:
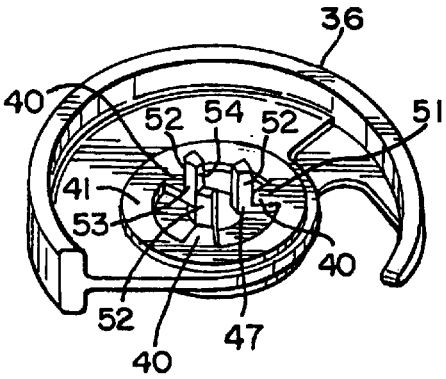
FIG. 10 is a perspective view of a cam of the sash lock of FIGS. 7–8.
Figure 11:
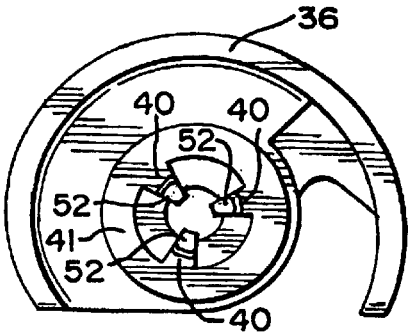
FIG. 11 is a top plan view of the cam of FIG. 10.

Referring to FIGS. 7–11, another embodiment of a sash lock is shown generally referred to with the reference number 50. For simplicity, common elements between the sash lock 10 of FIGS. 1–6 and the sash lock 50 of FIGS. 7–11 share the same reference numbers. This embodiment is similar to the first embodiment shown in the previous figures, with the primary exception that the cam 36 includes engagement members that include three finger-like projections 52 that extend generally transversely beyond the face surface 41 toward the shaft 38 to engage the shaft 38 of the actuator arm 34. In a preferred embodiment, each of the projections 52 is disposed adjacent to the distal end 47 of one of the protrusions 40, as shown in FIGS. 10 and 11. Thus, in this embodiment, the engagement member may include the protrusion 40 in the form of a base 51 wherein the projection 52 extends at the distal end 47 of the base 51. The protrusions 40 remain circumferentially-spaced to define the cavities 43. The projections 52 define a pair of side surfaces 53 and an end surface 54. The side surfaces 53 provide surface engagement with the shaft engagement portions 44 when the projections 52 are disposed within the slots 42 of the shaft 38. Thus, the projections 52 increase the surface engagement between the shaft 38 and the cam 36, as shown in FIG. 8. This increased surface engagement enhances the engagement of the shaft 38 of the actuator arm 34 to the cam 36 to resist undesirable movement therebetween. Additionally, the end surfaces 54 of the projections 52 provide for an increase in engagement with the screw 38*d*. It is further understood that the shaft engagement portions 44 are received by the cavities 43.

The three shaft engagement portions 44 of the shaft 38 deflect and squeeze the projections 52 of the cam 36 in response to advancement of the screw 38*d* disposed within the thru-hole of the cam and the blind hole of the shaft 38 when torque is applied to the screw 38*d* during assembly. As the screw advances, the shaft engagement portions 44 press against the side surfaces 53 to provide a robust engagement of the actuator arm 34 to the cam 36.

As further shown in FIGS. 7 and 9, the keeper 26 has a pair of keeper flanges 27. The keeper flange 27 extends from a central raised portion of the keeper 26 to a base portion of the keeper 26. The keeper flange 27 cooperates with the adjacent keeper alignment surface 26*d* to form a recess 29.

The keeper flange 27 defines a flange face surface 27*a*. The recess 29 receives the alignment tab 33 wherein a tab surface 33*a* is in confronting relation to the flange face surface 27*a* when the sash windows 14,16 are in a closed position to align the keeper 26 with the locking assembly 28. This structure enhances the fit between the housing 30 and the keeper 26. The keeper flanges 27 add rigidity to the keeper 26 to reduced possible flexing of the keeper 26. The alignment tab 33 also engages a base surface of the keeper 27 that assists in reducing tension stress on the mounting screws of the keeper 26 when the sash lock 10,50 is locked and the lower sash 16 is pulled upwards.

The present invention provides a robust assembly having enhanced engagement between the actuator arm 34 and the cam 36 through increased surface engagement between the shaft engagement portions 44 and the protrusions 40 and the projections 52, as well as increased surface engagement with the screw 38*d*. This enhanced engagement resists unwanted movement between parts. Undesirable rotational movement is prevented between the shaft 38 of the actuator arm 34 and the cam 36 when a force is applied to the actuator arm 34 to rotate the cam 36. Furthermore, the protrusions 40 and the projections 52 can also be utilized as locating or keying features during assembly of the sash lock 10,50.

While the specific embodiments have been illustrated and described, numerous modifications come to mind without significantly departing from the spirit of the invention and the scope of protection is only limited by the scope of the accompanying Claims.

What is claimed is:

1. A sash lock for a sash window assembly, the sash window assembly including an upper sash window and a lower sash window, each of the sash windows mounted within opposed guide rails on a master frame, wherein at least one of the sash windows is slidable within the frame relative to the other sash window and one of the windows having a keeper mounted on a rail, the keeper including a keeper surface, the sash lock comprising:

a locking assembly for mounting on a rail of the window without the keeper, the locking assembly including:

a housing having an aperture;

an actuator arm having a shaft disposed along a rotational axis and within the aperture of the housing; and a cam having a cam surface adapted for engaging the keeper surface of the keeper and at least one engagement member that engages the shaft of the actuator arm wherein the cam includes a thru-hole and the shaft includes a blind hole adapted to accept a screw disposed within the thru-hole of the cam wherein the shaft includes at least one slot peripherally disposed about the blind hole that correspondingly engages with the at least one engagement member of the cam wherein the at least one peripherally-disposed slot defines at least one shaft portion peripherally disposed about the blind hole wherein the at least one shaft portion deflects and squeezes the at least one engagement member of the cam in response to advancement of the screw disposed within the thru-hole of the cam and the blind hole of the shaft when torque is applied to the screw during assembly.

2. The sash lock of claim 1, wherein the housing and the actuator arm are formed of a plastic material and the cam is formed of a metal material.

3. The sash lock of claim 1, wherein the shaft includes three slots peripherally disposed about the blind hole and the cam includes three engagement members that correspondingly engage the slots.

4. A sash lock for a sash window assembly, the sash window assembly including an upper sash window and a lower sash window, each of the sash windows mounted within opposed guide rails on a master frame, wherein at least one of the sash windows is slidable within the frame relative to the other sash window, and one of the windows having a keeper mounted on a rail, the keeper including a keeper surface, the sash lock comprising:

a locking assembly for mounting on a rail of the window without the keeper, the locking assembly including:

a housing having an aperture;

an actuator arm having a shaft disposed along a rotational axis and within the aperture of the housing; and a cam having a cam surface adapted for engaging the keeper surface of the keeper, a face surface, and at least one projection extending transversely beyond the face surface toward the shaft to engage the shaft of the actuator arm wherein the cam includes a thru-hole and the shaft includes a blind hole adapted to accept a screw disposed within the thru-hole of the cam wherein the shaft includes three slots peripherally disposed about the blind hole and the cam includes three projections that are correspondingly received by the slots wherein the three peripherally-disposed slots define three shaft engagement portions each having a generally wedge-shaped cross-section taken perpendicular to the rotational axis of the actuator arm wherein the three shaft engagement portions deflect and squeeze the projections of the cam in response to advancement of a screw disposed within the thru-hole of the cam and the blind hole of the shaft when torque is applied to the screw during assembly.

5. The sash lock of claim 4, wherein the housing and the actuator arm are formed of a plastic material and the cam is formed of a metal material.

6. A sash lock for a sash window assembly, the sash window assembly including an upper sash window and a lower sash window, each of the sash windows mounted within opposed guides on a master frame, wherein at least one of the sash windows is slidable within the frame relative to the other sash window, and one of the windows having a keeper mounted on a rail of the window, the keeper including a keeper surface, the sash lock comprising:

a locking assembly for mounting on a rail of the window without the keeper, the locking assembly including:

a housing having an aperture;

an actuator arm having a shaft disposed along a rotational axis and within the aperture of the housing, the shaft having a blind hole and threes lots peripherally disposed about the blind hole, the three slots defining three shaft engaging portions each having a generally wedge-shaped cross section taken perpendicular to the rotational axis of the actuator arm; and a cam having a cam surface for engaging the keeper surface of the keeper, the cam further having three finger-like projections extending generally parallel to the rotational axis of the actuator arm, each finger like projection being received and engaged by a respective slot to operably couple the cam to the shaft, the cam further including a through hole;

wherein the blind hole is adapted to accept a screw disposed within the thru-hole of the cam and wherein the three shaft engaging portions are adapted to deflect and squeeze the projections of the cam in response to advancement of the screw disposed within the thru-hole of the cam and the blind hole of the shaft when torque is applied to the screw during assembly.

7. The sash lock of claim 6, wherein the keeper, the housing, and the actuator arm are formed of a plastic material and the cam is formed of a metal material.

8. A sash lock for a sash window assembly, the sash window assembly having an upper sash window and a lower sash window, each of the sash windows mounted within opposed guide rails on a master frame, wherein at least one of the sash windows is slidable within the frame relative to the other sash window and one of the sash windows having a keeper mounted on a rail, the keeper having a keeper surface, the sash lock comprising:

a locking assembly comprising:

a housing having an aperture, the housing adapted to be mounted on a rail of the sash window without the keeper;

an actuator arm having a shaft disposed along a rotational axis and within the aperture of the housing the shaft having a shaft engagement portion; and a cam having a cam surface adapted for engaging the keeper surface of the keeper, the cam having an engagement member that engages the shaft of the actuator arm the engagement member comprising a protrusion wherein the shaft engagement portion deflects and compresses the protrusion in response to a screw inserted into a thru-hole of the cam and a blind hole of the shaft.

9. The sash lock of claim 8, wherein the shaft has a slot that receives the engagement member.

10. The sash lock of claim 8, wherein the shaft has a slot and the protrusion is received by the slot.

11. The sash lock of claim 10, wherein the protrusion has a side surface and the slot defines a shaft engagement portion wherein the side surface engages the shaft engagement portion.

12. The sash lock of claim 8, wherein the protrusion has an end surface that engages the screw.

13. The sash lock of claim 11, wherein a cavity is defined adjacent the protrusion, the shaft engagement portion being received by the cavity.

14. The sash lock of claim 10, in the engagement member further comprises a projection adjacent the protrusion, the projection being received by the slot.

15. The sash lock of claim 8 wherein the engagement member comprises a plurality of spaced protrusions and the shaft having a plurality of spaced slots, each protrusion being received by a slot.

16. The sash lock of claim 15 wherein cavities are defined between the spaced protrusions on the cam and shaft engagement portions are defined between the slots of the shaft, each shaft engagement portion being received by a respective cavity.

17. The sash lock of claim 16 wherein the engagement member further comprises a projection adjacent each protrusion, the projections being received by the slots.

18. The sash lock of claim 8 wherein the engagement member comprises three protrusions, each protrusion having a projection adjacent thereto, the protrusions being spaced by three cavities, and the shaft having three slots spaced by three shaft engagement portions, each slot receiving a projection and protrusion and each cavity receiving one of the shaft engagement portions.

19. The sash lock of claim 18 wherein shaft engagement portions deflect and squeeze the protrusions and projections in response to a screw inserted into a thru-hole of the cam and blind hole of the shaft.

20. The sash lock of claim 8 wherein the housing and the actuator arm are formed of a plastic material and the cam is formed of a metal material.

21. A sash lock for a sash window assembly, the sash window assembly including an upper sash window and a lower sash window, each of the sash windows mounted within opposed guide rails on a master frame, wherein at least one of the sash windows is slidable within the frame relative to the other sash window, the sash lock comprising:

a keeper for mounting on a style of one of the sash windows, the keeper including a keeper surface; and a locking assembly for mounting on an adjacent style of the other of the sash windows, the locking assembly including:

a housing having an aperture;

an actuator arm;

a cam having a cam surface for engaging the keeper surface; and a shaft extending through the housing aperture and operably coupling the actuator arm to the cam;

the housing and the shaft adapted to limit rotational travel of the actuator arm to define unlocked and locked position wherein the actuator arm engages a protrusion of the housing in the unlocked position and in the locked position.

22. The sash lock of claim 21, wherein the keeper, the housing, the actuator arm and the shaft are formed of plastic and the cam is formed of metal.

23. A sash lock for a sash window assembly, the sash window assembly including an upper sash window and a lower sash window, each of the sash windows mounted within opposed guide rails on a master frame, wherein at least one of the sash windows is slidable within the frame relative to the other sash window, the sash lock comprising:

a keeper for mounting on a style of one of the sash windows, the keeper including a keeper surface; and a locking assembly for mounting on an adjacent style of the other of the sash windows, the locking assembly including:

a housing having an aperture;

an actuator arm having a shaft;

a cam having a cam surface for engaging the keeper surface; and a shaft extending through the housing aperture and operably coupled to the cam, the shaft and the housing arranged to cooperatively limit rotational travel of the arm with respect to the housing wherein the shaft and the aperture have corresponding surfaces; the shaft has a shaft projection extending from its circumferential surface; and the aperture has two spaced aperture projections on its circumferential surface, wherein the shaft projection engages one of the aperture projections to define an unlocked position and engages the other aperture projection to define a locked position.

24. The sash lock of claim 23, wherein the keeper, the housing, the actuator arm and the shaft are formed of plastic and the cam is formed of metal.

25. A sash lock for a sash window assembly, the sash window assembly having an upper sash window and a lower sash window, each of the sash windows mounted within opposed guide rails on a master frame, wherein at least one of the sash windows is slidable within the frame relative to the other sash window and one of the sash windows having a keeper mounted on a rail, the keeper having a keeper surface, the sash lock comprising:

a locking assembly comprising:

a housing having an aperture, the housing adapted to be mounted on a rail of the sash window without the keeper;

an actuator an having a shaft disposed along a rotational axis and within the aperture of the housing; and a cam having a cam surface adapted for engaging the keeper surface of the keeper, the cam having an engagement member that engages the shaft of the actuator arm wherein the engagement member comprises three protrusions, each protrusion having a projection adjacent thereto, the protrusions being spaced by three cavities, and the shaft having three slots spaced by three shaft engagement portions, each slot receiving a projection and protrusion and each cavity receiving one of the shaft engagement portions and wherein the shaft engagement portions deflect and squeeze the protrusions and projections in response to a screw inserted into a thru-hole of the cam and blind hole of the shaft.

26. A sash lock for a sash window assembly, the sash window assembly having an upper sash window and a lower sash window, each of the sash windows mounted within opposed guide rails on a master frame, wherein at least one of the sash windows is slidable within the frame relative to the other sash window and one of the sash windows having a keeper mounted on a rail, the keeper having a keeper surface, the sash lock comprising:

a locking assembly comprising:

a housing having an aperture, the housing adapted to be mounted on a rail of the sash window without the keeper;

an actuator arm having a shaft disposed along a rotational axis and within the aperture of the housing, the shaft having a slot; and a cam having a cam surface adapted for engaging the keeper surface of the keeper, the cam having an engagement member comprising a protrusion and a finger like projection adjacent the protrusion wherein the protrusion and the finger like projection are received by the slot.

27. The sash lock of claim 26 wherein the shaft further comprises a second and third slot and the cam further comprises a second engagement member having a second protrusion and a second finger like projection adjacent the protrusion and a third engagement member having a third protrusion and a third finger like projection adjacent the protrusion wherein the second slot receives the second protrusion and second finger like projection and the third slot receives the third protrusion and third finger like projection.

* * * * *